United States Patent [19]

Meier

[11] 4,174,685

[45] Nov. 20, 1979

[54] TWO STROKE CYCLE INTERNAL COMBUSTION ENGINE

[75] Inventor: Hermann R. E. Meier, Palma de Mallorca, Spain

[73] Assignee: AB Volvo Penta, Gothenburg, Sweden

[21] Appl. No.: 922,093

[22] Filed: Jul. 5, 1978

[51] Int. Cl.[2] ..... F02F 3/24

[52] U.S. Cl. ..... 123/73 A; 123/65 A; 123/73 SP

[58] Field of Search ..... 123/65 A, 65 P, 65 PD, 123/73 R, 73 A, 73 B, 73 PP, 73 SP; 92/141

[56] References Cited

U.S. PATENT DOCUMENTS

| | | | |
|---|---|---|---|
| 1,110,332 | 9/1914 | Miller | 123/73 B |
| 1,148,720 | 8/1915 | Schultz et al. | 123/65 A |
| 1,203,791 | 11/1916 | Schnichel | 123/73 A |
| 1,693,506 | 11/1928 | Hemmingsen | 123/65 A |
| 2,055,026 | 9/1936 | Cook | 123/65 A |
| 3,494,335 | 2/1970 | Meier | 123/73 R |
| 4,088,098 | 5/1978 | Rose et al. | 123/73 A |

FOREIGN PATENT DOCUMENTS

| | | | |
|---|---|---|---|
| 134555 | 4/1933 | Austria | 123/65 A |
| 775698 | 1/1935 | France | 123/73 A |
| 1435958 | 10/1973 | United Kingdom | 123/73 A |

*Primary Examiner*—Charles J. Myhre
*Assistant Examiner*—David D. Reynolds
*Attorney, Agent, or Firm*—George H. Baldwin; Arthur G. Yeager

[57] ABSTRACT

A two-stroke cycle internal combustion engine wherein the cylinder is provided with spaced inlet ports with an intermediate wall section therebetween and the piston face is provided with a T-shaped guide outstanding therefrom, the center leg of the guide terminating in a face, which confronts the intermediate wall section when the piston is at bottom dead center, the face increasing in width from the outer edge of the guide leg to the root thereof.

9 Claims, 7 Drawing Figures

TWO STROKE CYCLE INTERNAL COMBUSTION ENGINE

BACKGROUND OF THE INVENTION

There are currently in use two basic designs in two stroke cycle engines, loop-scavenged engines with flat-top pistons, and cross-flow engines having a guide, or deflector, on the piston crown or face.

In loop-scavenged engines, gas flow in the cylinder is controlled and directed by the arrangement, shape and inclination of the transfer passages and the inlet and outlet ports. Generally, the fresh charge entering the cylinder is directed towards the cylinder wall opposite the exhaust port, thereby avoiding to some degree loss of fresh charge through the exhaust port.

The effectiveness of this system depends not only on the correct arrangement of the transfer passages and ports but to a large degree on the stability of the gas streams entering the cylinder. At low engine speeds (small throttle opening) the pressure differential in the crankcase is low, and therefore the force behind the gas streams moving through the transfer passages is low. The result is a loss of stability of the gas streams entering the cylinder. Due to this instability, the desired gas flow pattern in the cylinder may not be achieved and some loss of fresh charge through the exhaust port is inevitable. Fuel consumption at low engine speeds is high. Idling is irregular and there may be four-stroking.

Production costs of loop-scavenged engines are high due to the complexity of casting cylinders with the required arrangement of the transfer passages.

In cross-flow engines the transfer or inlet ports are placed opposite the exhaust port. Gas streams entering the cylinder through the transfer ports, upon meeting a deflector, guide, or baffle on the piston crown, are deflected upwardly, that is, away from the crown and toward the combustion chamber. In the usual cross-flow engine this may not result in efficient scavenging or filling of the cylinder. In addition to the direction of the gas flow being towards the exhaust port, a low-pressure zone at this port tends to pull a considerable amount of fresh charge over and across the deflector into the exhaust port instead of permitting the gas stream to move upwardly and along the cylinder wall portion which lies opposite the exhaust port. A particular advantage of the crossflow design is the simplicity of the port arrangement. Production costs are low since the design of the cylinder lends itself to the application of high-pressure die-cast methods of manufacture.

As used herein, the term "upward" is intended to mean the direction perpendicularly away from the piston crown toward the closed end of the cylinder and term "horizontal" is intended to mean parallel to the piston crown, without thereby implying that the cylinder should be disposed in an upright position.

Certain improvements and arrangements of the deflectors or guides, ports, and transfer passages for two stroke cycle engines are described in my U.S. Pat. No. 3,494,335 which provide good results with respect to the gas flow characteristics. It was found that the two inlet port arrangements shown in that patent, wherein the two incoming gas streams were directed in generally horizontal directions toward each other, and wherein the streams intersected between the ports, could be improved by the addition of a third inlet port located between such two ports as shown in FIGS. 6 and 7 thereof. The transfer passage for the intermediate port was arranged to provide an upwardly directed gas stream, that is, a stream directed away from the piston face toward the combustion chamber portion of the cylinder at the closed end of the cylinder, thus to increase the upward component of, or to lift, the fresh charge away from the piston face.

The intersection of the generally oppositely flowing gas streams without the intermediate port resulted in substantial turbulence, and, when a stream from such intermediate port was directed into such intersection, there was a further tendency to disturb the flow pattern of the two main gas streams resulting in no effective reduction of the undesired turbulence.

Another approach to the problems of efficiently scavenging two stroke cycle engines is represented by French Pat. No. 775,698 issued in 1934 to Cycles Peugeot, wherein a T-shaped deflector or guide is provided on the piston crown. A first part of the guide extends laterally across the piston crown separating the inlet ports from the exhaust port and a second leg flange part extends from the center of the first part toward the piston wall portion which lies between the inlet ports. Two more or less opposed gas streams enter the cylinder generally horizontally to be guided along the first laterally extending part of the deflector toward the second leg flange part, which part then deflects the gas streams upwardly toward the combustion chamber.

The arrangement of the transfer or inlet ports of the Peugeot engine undesirably restricts the effective cross-sectional port area that can be obtained, and this limits the specific power output.

OBJECTS OF THE INVENTION

A general object of the invention is to improve the performance of cross-scavenged two-stroke cycle engines, and more specifically to improve the fuel efficiency and the low and idling speed performance of such engines. A further specific object is to improve the configuration of the guide outstanding from the face or crown of the piston and the arrangement of the inlet ports and the transfer passages leading thereto in a two-stroke cycle engine to provide better scavenging of the spent or combusted gases from the cylinder and to minimize the necessary distance between adjacent cylinders in an engine with two or more cylinders.

A still further object is to increase the specific power output of two stroke cycle, cross-scavenged engines which have guide or deflector means on the piston crown.

A specific object of the invention is to provide an efficient cross-scavenged engine having two minimally spaced transfer passages allowing close spacing of adjoining cylinders, thus to permit the use of a crankshaft sufficiently short as to make unnecessary a crankshaft bearing between such adjoining cylinders.

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

Figure 1:
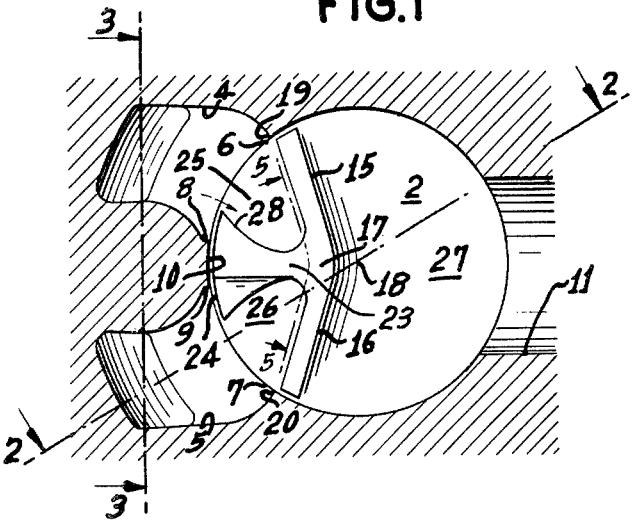
FIG. 1 is a sectional plan view of a cylinder and piston in accord with the invention.
Figure 3:
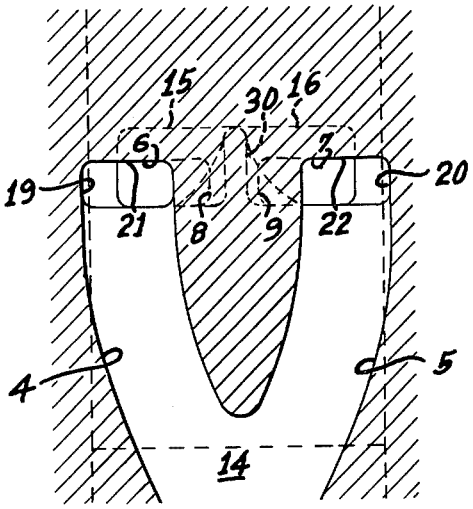
FIG. 3 is a sectional view taken along line 3—3 of FIG. 1.
Figure 2:
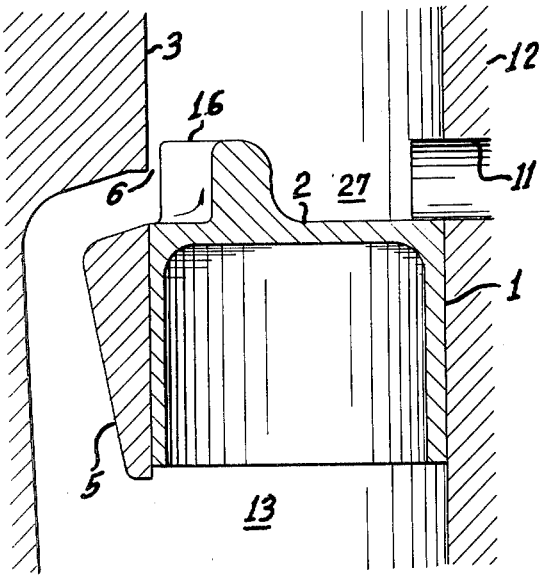
FIG. 2 is a sectional view taken along line 2—2 of FIG. 1.

Referring now to the drawings, a piston 1 having a face or crown 2 is disposed in a cylinder 3, the piston being shown in bottom dead center position. Two transfer passages 4 and 5 are provided, terminating in inlet ports 6 and 7 which are circumferentially spaced along the cylinder wall. The inner edges 8 and 9 of the ports 4 and 5 define therebetween an intermediate wall portion 10 of the cylinder. The cylinder is further provided with exhaust port means disposed opposite to such intermediate wall portion as represented by exhaust port 11 in the illustrated embodiment. The transfer passages extend through the cylinder block generally indicated at 12 and are arranged to transfer fresh gases from the crankcase interior 13. The passages 4 and 5 may join as shown at 14 to open together into the crankcase.

The crown 2 of the piston is provided with outstanding deflector, guide or flange arms 15 and 16 extending outwardly from a meeting area 17, which is spaced slightly away from the center 18 of the piston crown toward the intermediate wall portion 10, and together forming a continuous wall extending laterally across the crown between the outer edges 19 and 20 of the inlet ports 6 and 7. The deflector arms extend upwardly, that is, away from the piston face, to a height greater than the height of the upper edges 21 and 22 of the ports above the piston face when the piston is in bottom dead center position. The arms 15 and 16 are joined at the meeting area 17 by a nose or leg deflector or flange portion 23 which extends toward and which terminates in confronting relation to the intermediate wall section 10 in a generally triangular end face 24 which is arcuate to conform to the cylindrical wall surface of the cylinder. More particularly, the nose flange 23 is, preferably, equal in height to the height of the arms 15 and 16 and forms therewith a guide having a generally "T" shape in plan view.

The lateral guide arms 15 and 16, together with the cylinder wall and the face 2 of the piston, define an open inlet chamber within the cylinder consisting of two portions 25 and 26 on respectively opposite sides of the leg flange portion 23 and an outlet chamber 27 defined between the arms 15 and 16 and the exhaust port 11 and the portions of the cylinder wall adjacent the port.

The transfer passages 4 and 5 will be seen to curve from a substantially vertical portion into a horizontal but slightly upwardly directed portion as they approach the inlet ports. The nearly horizontal portions, in turn, curve from initial parallel directions into short inwardly directed portions immediately adjacent the ports.

Figure 4:
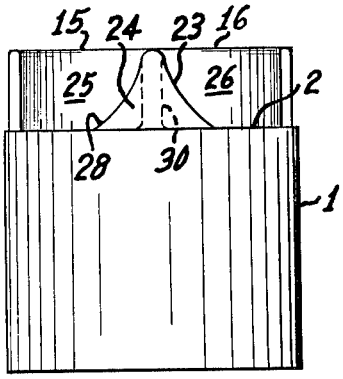
FIG. 4 is a side elevational view of the piston of FIGS. 1-3.
Figure 5:
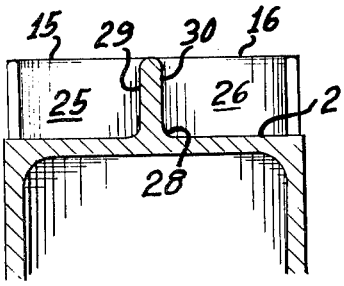
FIG. 5 is a sectional view of the piston taken along line 5—5 of FIG. 1.

It is to be particularly noted that the root 28 at which the nose or leg flange portion 23 meets the piston crown 2 is substantially broader at its end face 24 than at its intersection, at meeting area 17, with the transverse flange arms 15, 16. Thus the sides 29, 30 of the leg flange portion are seen in FIG. 5, and in broken lines in FIG. 4, to be substantially upright and parallel adjacent the intersection of the leg flange portion with the transverse flange portion. The root 28 gradually widens with distance from the transverse flange or deflector to the end face 24, where, as shown, the nose flange portion is, in cross section, of generally wide-based triangular shape, the root being substantially wider than the distance between the inner edges 8 and 9 of the inlet ports.

As the piston descends toward bottom dead center and as the piston crown moves downwardly below the upper edges of the inlet ports, narrow openings, through which the compressed gas-air mixture enters the inlet chamber, are first established along the outer portions of the upper edges of the inlet ports, on opposite sides of the wide root portion of the end face 24, and, as the piston movement progresses, the openings become larger in the vertical dimension and with a progressively diminishing distance between the inner edges of the two openings.

When the piston reaches bottom dead center position, the port openings are generally trapezoidal in shape bounded or defined by upwardly and inwardly inclined inner edges, horizontal upper and lower edges, and vertical outer edges. The effect is to create low pressure zones along the sides of the nose flange, particularly in that the root dimension of the nose flange decreases with distance from the face 24 toward the meeting area 17 with transverse flange 15, 16. The inlet streams are thus deflected toward the sides of the nose flange portion.

The sides of the nose flange portion and the sides of the transverse flange arms 15 and 16 are radiused into the piston crown, and as the gas streams meet the flanges, they are deflected upwardly. The deflected streams meeting above the nose flange portion are moving in substantially parallel directions and join with minimal turbulence.

Figure 6:
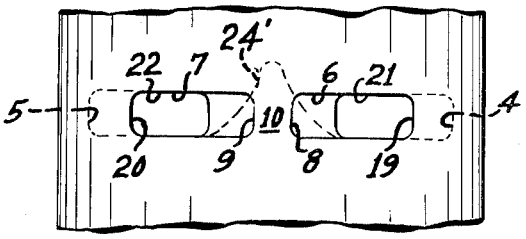
FIG. 6 is a fragmental elevational view of a portion of the interior wall of the cylinder, with the piston removed.

FIG. 6 shows the ports 6 and 7 and intermediate wall portion 10 as viewed from within the cylinder, the relative position of the end face 24 of the nose portion when the piston is in bottom dead center position being represented in broken lines at 24'.

The Peugeot arrangement relies upon generally oppositely oriented inlet ports and with the transfer passages being so oriented adjacent the ports as to direct the incoming streams nearly perpendicularly in opposite directions toward the respective sides of the leg portion of the T-shaped deflector for the purpose of causing the streams to be upwardly deflected from the inlet chamber, and further relies upon a small inlet chamber on the inlet side of the transfer portion of the deflector for the purpose of causing the upwardly deflected gases to pass close to the cylinder wall above the inlet ports. In contrast, the inlet ports according to the present invention are wider, each subtending an arc of approximately 45 degrees of the cylinder circumference as opposed to an arc of approximately 32 degrees shown in the Peugeot patent, and with the transfer passages in the present arrangement so oriented adjacent the inlet ports as to cause the gas streams to enter the cylinder in directions more toward the transverse portions of the deflector. The streams, according to the present invention, because of the shape of the nose portion 23, after entering the cylinder, are deflected inwardly toward suction or low pressure zones on each side of the nose portion, and, as they meet the transverse arm portions 15 and 16, they are deflected upwardly to sweep the portions of the cylinder above the inlet chamber. The upward deflection of the streams as they encounter the transverse deflector tends to oppose any passage of inlet gases over the top of the transverse deflector more effectively than in the Peugeot arrangement, wherein there is turbulence along that portion of the converging streams which is closest to the outlet port, that is, the portion of the converging streams which is located generally above the intersection between the leg and the transverse portions of the deflector. Such stream portion, in Peugeot, is not opposed by a stream directed upwardly by the transverse portions of the deflector. Since there is in the present arrangement a substantial upward flow created by the portions of the streams which meet and are deflected upwardly by the transverse deflector portions, the overall result of the arrangement according to the present invention is that there is an enhanced tendency toward upward flow adjacent the cylinder wall portion above the inlet port area and generally above the inlet chamber, with less turbulence and less leakage over the transverse barrier than with the Peugeot arrangement. At the same time, as compared to Peugeot, the position of applicant's inlet ports is more directly opposite the exhaust port, applicant's inlet streams enter the cylinder with a greater component of flow direction toward the exhaust port, applicant's inlet ports are larger relative to the cylinder diameter, and applicant's inlet chamber is larger relative to the area of the piston crown.

The inwardly deflecting effect of the nose or leg flange configuration, as characterized by the wide root thereof at the edge of the piston toward the inlet ports and intermediate wall section, and by the much narrower shape adjacent the transverse flange portions, provides inward deflection of the streams within the cylinder, both when the ports are first partially uncovered and for so long thereafter as inlet gases are entering the cylinder. This inward deflection permits the initial angle between the streams to be substantially less than would be the case if pockets of reduced pressure were not formed along the sides of the nose flange portion adjacent the transverse flange portion. It is thus not necessary in the present invention that the inwardly directed portions of the transfer passages adjacent the ports extend for a sufficient distance to completely redirect the streams into the directions at which the transfer passages meet the inlet ports, it being noted that the passages in Peugeot do so extend. According to the invention, therefore, the distance between the transfer passages is minimized thereby to permit reduction of the width of the cylinder block in single cylinder engines. Such minimizing of the distance is of great advantage in an engine with two adjoining cylinders, wherein, because of the resultant minimizing of the distance between the main crankshaft bearings in a two cylinder engine, for example, it becomes possible to omit an intermediate crankshaft bearing between the cylinders, or, in a multi-cylinder engine, to omit one or more of the intermediate crankshaft bearings between one or another pair of adjoining cylinders.

Figure 7:
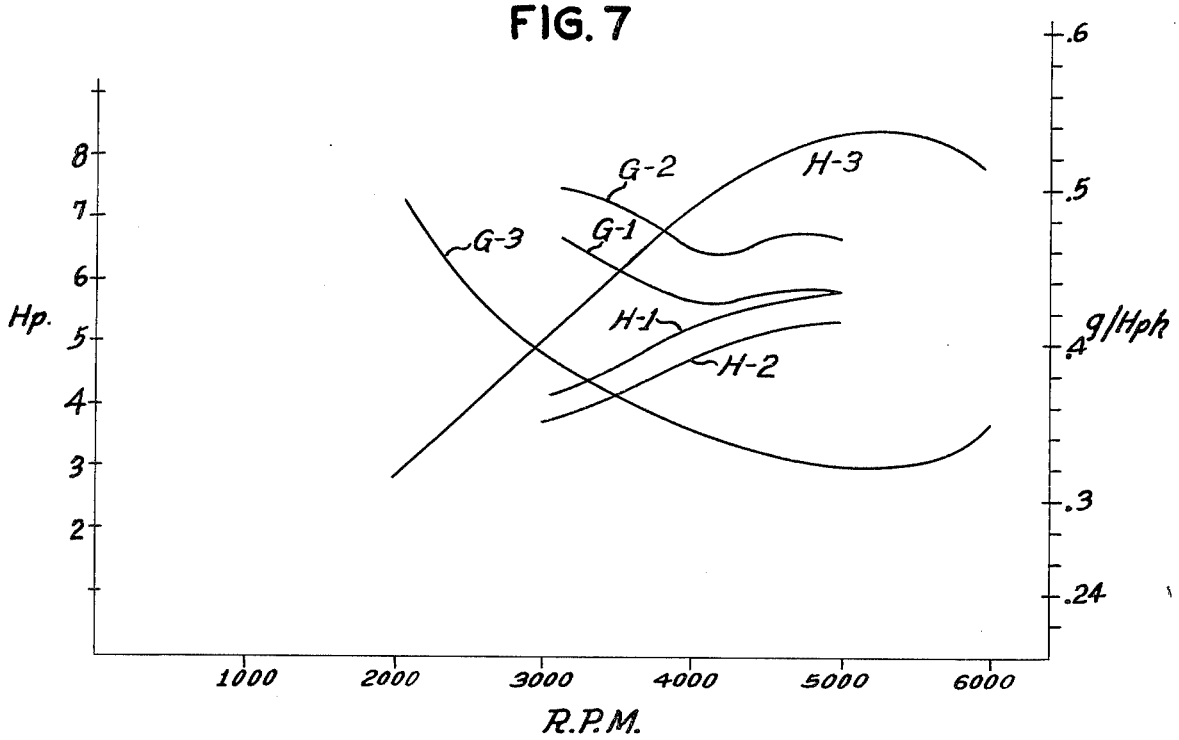
FIG. 7 is a graphic representation of performance test results of engines according to the invention and of an engine in accord with said Peugeot patent.

Laboratory tests of engines having one as against another configuration of deflector on the piston crown are difficult and costly, and cannot provide entirely unequivocal results in view of the many variables, as, for example, in spark plug placement, combustion chamber size and configuration, ignition timing and the like. Curves showing the performance obtained by tests of engines embodying the herein described and claimed deflector and port arrangements as against arrangements patterned and intended to be in accord with the engine disclosed in the aforesaid Peugeot patent are shown in FIG. 7, wherein curves G-1 and H-1 show grams per horsepower hour and horsepower, respectively, plotted against RPM, derived from a test of an engine embodying the deflector and port arrangement according to the present invention, while the corresponding curves G-2 and H-2 show the performance of an engine in accord with the Peugeot patent, the tests having been conducted in a manner intended to offer as nearly as possible a correct comparison. As will be seen, at 4000 r.p.m. the engine in accord with this invention provided, approximately, 10 percent greater horsepower with, approximately, 8 or 9 percent less fuel per horsepower hour. Other similar comparative tests have produced results which are similar to those presented in FIG. 7.

Following further specific refinements and optimization of variables, the performance characteristics represented by curves G-3 and H-3 have been obtained in laboratory tests of engines in accord with the present invention. The very good fuel economy represented by curves G-3 and H-3, has been accompanied by excellent low speed and idling performance.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A two stroke cycle internal combustion engine having a piston reciprocating to and from a bottom dead center position in a closed cylinder, said cylinder having a wall provided with two inlet ports and generally oppositely disposed outlet port means, said inlet ports being circumferentially spaced and having inner edges defining an intermediate section of said wall therebetween, and a generally T-shaped guide outstanding from the face of said piston, the arms of said T-shaped guide comprising a first flange portion outstanding from the face of the piston extending laterally of the path between said inlet ports and said outlet port means and spaced therebetween and delimiting an open inlet chamber between said first flange portion, on the one hand, and said inlet ports and intermediate wall section, on the other hand, the leg of said T-shaped guide comprising a second flange portion outstanding from the face of the piston and extending from an intermediate portion of said first flange portion toward said intermediate wall section and terminating in an end face which confronts said intermediate section when said piston is at bottom dead center position, said flange portions extending outwardly from roots at which they join the piston face to outer flange edges, characterized in that, said end face increases in width from the outer flange edge to the root of said second flange portion and has a width at said root greater than the distance between the upper inner edges of said ports, said piston and the edges of said inlet ports defining inlet openings into said cylinder having generally trapezoidal shapes when said piston is in bottom dead center position, each such opening being defined between an upper port edge substantially parallel to the face of the piston, an outer edge generally perpendicular to the piston face defined by those respective edges of the outer ends of said arms which delimit such inlet chamber, and each such opening being further defined by a lower edge defined by the piston face and by an inclined inner edge extending upwardly and inwardly from the inner end of said lower edge, said inwardly inclined inner edges terminating at spaced apart intersections with said upper edges, said inner edges being defined by the outer edges of said end face.

2. The combination according to claim 1 wherein the root of said second flange portion decreases in width throughout at least about one-half of the distance from said end face to said intermediate portion of said first flange portion.

3. The combination according to claim 2 wherein said second flange portion comprises side faces which extend from said end face to said intermediate portion of said first flange portion and which immediately adjacent said intermediate portion are substantially parallel and substantially normal to said face of said piston.

4. The combination according to claim 1 wherein said ports have lower inner edge portions spaced apart by a distance which is less than the width of said end face at said root.

5. A two stroke cycle internal combustion engine having a piston reciprocating in a cylinder with two inlet ports and a generally oppositely disposed outlet port in the cylinder wall, said inlet ports being circumferentially spaced to define an intermediate portion of the cylinder wall therebetween, the crown of said piston having a T-shaped guide thereon extending from a root portion joined to and adjacent said crown generally perpendicuarly from said crown to an upper portion spaced from said crown, said guide including transverse arms extending from a meeting area, which is disposed along the center line from said intermediate wall portion to said outlet port, in laterally outward directions and a longitudinal leg joining said arms at said meeting area and extending therefrom along said center line and terminating in an end which, when said piston is in bottom dead center position, is in confronting relation with said intermediate wall portion, characterized in that said root portion of said leg decreases in thickness with distance from said end.

6. The engine according to claim 5 wherein said end of said leg is a generally triangular face based on said crown of which the root portion is wider than the distance across said intermediate wall protion between the inner edges of said inlet ports.

7. The engine according to claim 6 wherein said upper portion of said leg is of substantially constant width between said face and said meeting area.

8. An internal combustion engine piston having a crown provided with flanges extending perpendicularly therefrom and forming a generally T-shaped deflector of which the center leg comprises a portion having substantially parallel sides at its meeting with the juncture of the arms and the root of the leg widens with distance from said juncture toward an end of said leg at the edge of said crown, said end forming a curved triangular face based on said crown extending perpendicularly of said crown and aligned with the cylindrical outer surface of the piston.

9. A piston in accord with claim 8 wherein the length of said leg between said juncture and said face is greater than one-quarter and not more than substantially one-third of the diameter of the piston.

* * * * *